United States Patent [19]

Hermann, 3rd

[11] 4,391,448

[45] Jul. 5, 1983

[54] METHOD OF PLAYING A TWO-PLAYER BOARD GAME

[76] Inventor: Conrad Hermann, 3rd, 1551 East Walnut La., Philadelphia, Pa. 19138

[21] Appl. No.: 226,431

[22] Filed: Jan. 19, 1981

Related U.S. Application Data

[62] Division of Ser. No. 967,223, Dec. 17, 1978, abandoned.

[51] Int. Cl.[3] ..... A63F 3/00

[52] U.S. Cl. ..... 273/243

[58] Field of Search ..... 273/260, 262, 255, 248, 273/242, 243, 258

[56] References Cited

U.S. PATENT DOCUMENTS

| | | | |
|---|---|---|---|
| 817,233 | 4/1906 | Emmerling | 273/260 |
| 1,492,072 | 4/1924 | Cornell et al. | 273/258 |
| 3,595,580 | 7/1971 | Bucko | 273/260 |
| 3,656,755 | 4/1972 | Thompson | 273/261 X |
| 3,791,648 | 2/1974 | Patterson | 273/248 |
| 3,799,547 | 3/1974 | Hills | 273/260 |
| 4,335,879 | 6/1982 | Wiskur | 273/260 |

FOREIGN PATENT DOCUMENTS

| | | | |
|---|---|---|---|
| 63187 | 8/1955 | France | 273/242 |

*Primary Examiner*—Richard C. Pinkham
*Assistant Examiner*—Scott L. Brown
*Attorney, Agent, or Firm*—Helmuth L. Pfluger

[57] ABSTRACT

A game for two contestants is played on a plane surface or board divided into a plurality of equal-sized squares having midway between the contestants a KETER ZONE comprising two rows of squares over the full width of the board, upon which at the start of the game playing pieces called KETER PAWNS are placed, one on each of the squares in the Keter Zone. Each contestant starts out with a uniquely distinguishable set of FIGHTING PAWNS OFF THE BOARD, equal in number to the number of Keter Pawns. At each contestant's end of the board an area equivalent to several squares is marked off as a HOME BASE; fighting pawns are generated on the board by moving keter pawns to the respective Home Base or by capturing keter pawns on the open board. The object of the game is for one of the contestants to become the winner by replacing all the keter pawns with his own fighting pawns, according to novel sequences of moves involving a periodic multimove "Operations of Fate" interval and according to novel rules for moving and capturing keter pawns and opponent's fighting pawns, the manner of capturing the two types of pawns being different from each other but always MAINTAINING THE TOTAL NUMBER OF PAWNS ON THE BOARD CONSTANT. Permitted quantity of squares for a move is determined by a random indicia-selecting device, but actual identity and direction of pieces moved are chosen as skillfully as possible by each contestant.

4 Claims, 4 Drawing Figures

METHOD OF PLAYING A TWO-PLAYER BOARD GAME

This is a division of application Ser. No. 967,223 filed Dec. 17, 1978, now abandoned.

This invention relates to a game for two players or adversaries. The game is carried out on a plane playing surface or board divided into a plurality of equal-sized squares and containing three special areas, hereinafter described and identified as the KETER ZONE and two respective HOME BASES. At the beginning of a game, playing pieces called KETER PAWNS are placed one on each of the squares of the keter zone which is midway between the players and comprises two rows of squares extending over the full width of the board. Each player starts out with a uniquely distinguishable set of FIGHTING PAWNS off the board, each set of fighting pawns being equal in number to the number of keter pawns.

At each player's end of the board an area equivalent to several squares is marked off as a HOME BASE. Fighting pawns are generated on the board by moving keter pawns to the player's own home base or by capturing keter pawns on the open board, which is the entire board exclusive of the home bases but including the keter zone.

The quantity of squares permitted for a move is determined by a random indicia-selecting device, but the actual identity and direction of pieces moved are chosen by the player with as much skill as possible.

The object of the game is for one of the players to become the winner by replacing all the keter pawns by his own variety of fighting pawns, according to novel rules for moving and capturing keter pawns and opponents pawns as hereinafter set forth. The modes of capturing the two types of pawns are different from each other but both procedures always maintain constantly the same total number of pawns on the board. When a keter pawn is captured, a fighting pawn from off the board is put in its place. But when an opponent's fighting pawn is captured and removed, a keter pawn from off the board is put back in the keter zone.

As described in detail below, said rules also provide novel sequences of moves wherein conventional strings of alternate play are interspersed with intervals comprising two "OPERATIONS OF FATE" in each of which a lucky player is randomly selected to make seven segmentary moves, each segment of which consists of the same randomly selected number of squares. Capture can be effected at the termination of each segmentary move which can be performed either by a single fighting pawn moving continuously or by seven separate pawns. These rules offer a unique challenge to each player's skill in designing moves in the face of unpredictable vicissitudes of "fate". If all keter pawns have been removed and the only fighting pawns of an opponent are in that opponent's Home Base, victory can be achieved precipitously by entering a fighting pawn into that otherwise impenetrable Home Base.

Many games have been proposed to be played on boards ruled out in squares, including the familiar chess and checkers and related games comprising direct antagonism between opposite pieces which, when captured, are removed permanently from the board. The Japanese "GO" is a game of encirclement in which the playing pieces are laid down on points of intersection instead of inside the squares.

To the best knowledge of the present inventor, no game board or method of playing thereon having the unique features of the present invention has been suggested in the prior art.

It has been found that the game of this invention is useful in training young players to think quickly in adjusting their strategy to unexpected shifts in fortune. It has also served to teach them that the best of plans can be frustrated not only by the skill of an adversary but also by random interventions of chance, thus providing a metaphor for the trials and struggles in life. However, this game is attractive not only to the young but in particular to advanced players who are intrigued by the possibilities of planning original strategies. It is therefore an ideal game for family entertainment involving old and young together.

In order that this invention may be better understood, the preferred embodiment thereof including apparatus and rules for play will now be described by way of example, with reference to the accompanying drawings.

Figure 1:
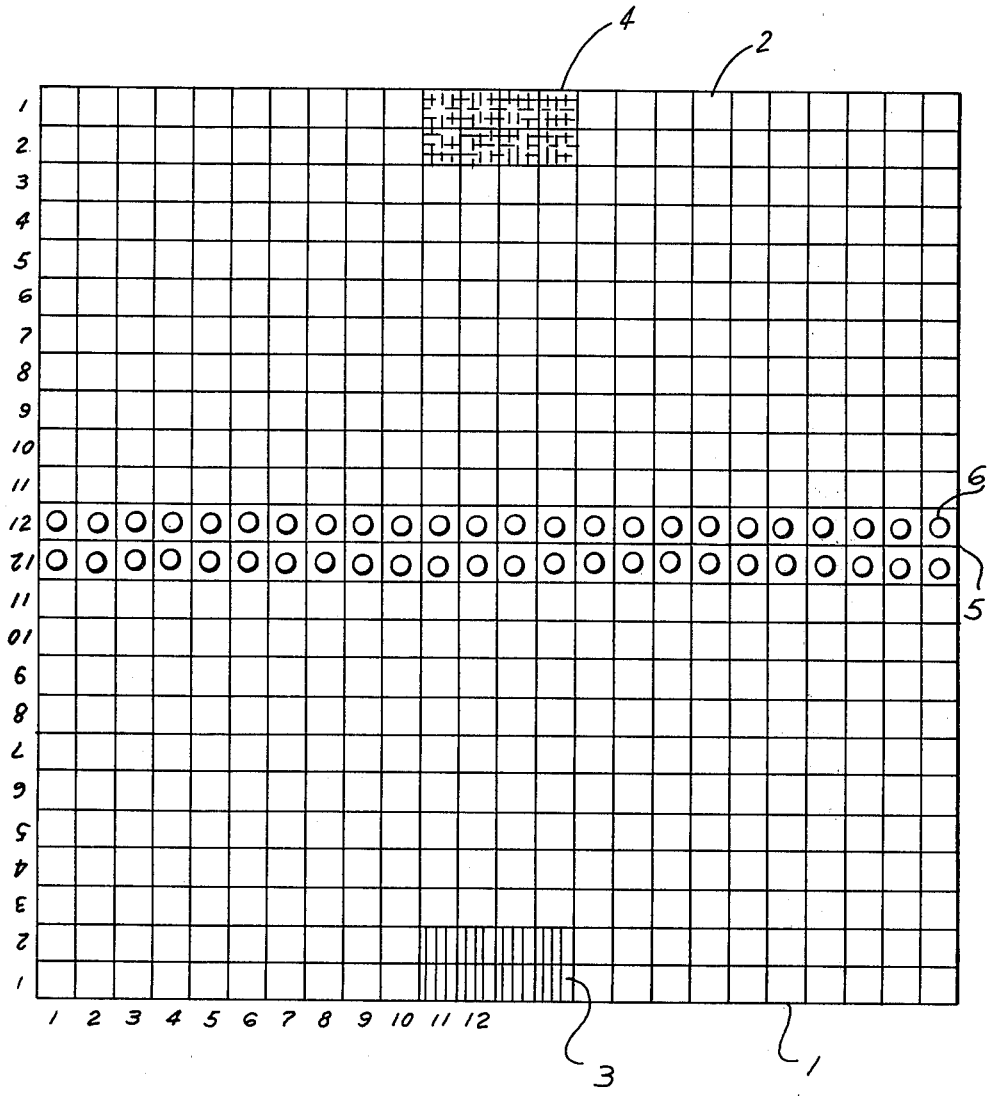
FIG. 1 is a plan view of the preferred playing surface.
Figure 2:
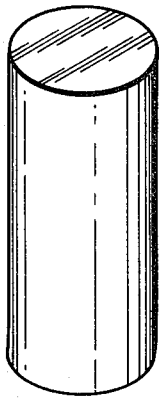
FIG. 2 shows a typical preferred cylindrical pawn which can exemplarily be about one inch high and about one-half inch in diameter as hereinafter set forth, particularly when the squares are about one inch square.
Figure 3A:
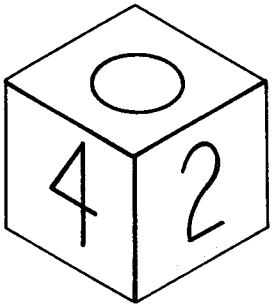
FIG. 3A represents a typical die with numbers.
Figure 3B:
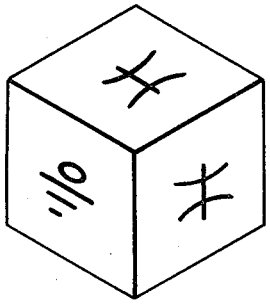

FIG. 3B represents another die used in the play of the game. This surface is a square board divided into 576 equal-sized unit squares, thus being 24 unit squares wide and 24 unit squares long. The two players or adversaries, playing from sides (1) and (2) respectively, can exemplarily be identified as POLTAR and MALKUT, or correspondingly by different colors such as, say, red and yellow. The board can be considered as divided into two halves of 12×24 squares, which halves are identifiable as the Poltar and Malkut halves. Each of these halves thus comprises twelve rows of squares which are appropriately identified as the first to twelfth row, counting from each respective player's side.

Most of the square are identical with the exception of two HOME BASES (3) and (4), and a KETER ZONE (5) which are situated as follows. The Keter Zone comprises the 48 squares midway between the players, situated thus on the twelfth row of the Poltar half and the twelfth row of the Malkut half. Each Home Base comprises eight squares which are the four squares in the middle of that side's first row and the four squares in the in the middle of the second row. Or, expressed otherwise, counting from either left or right, said squares are squares 11, 12, 13 and 14 in rows 1 and 2.

The Keter Zone and Home Bases are distinguished from the rest of the board by any suitable means such as color. Thus, the 48 squares of the Keter Zone, which are marked out as squares just like the rest of the board and considered part of the OPEN BOARD accessible to all pawns, can be gray or black or merely a darker shade of a color used for most of the squares. The Home Bases can be appropriately red and yellow, identifiable as the colors of Poltar and Malkut respectively. The Home Bases need not be marked out in squares, since the entire area within each Home Base is equal valued.

The overall size of the board will of course depend on the size of the individual squares. Squares of about one inch on each side are considered particularly suitable. The board can be made of any suitable material such as wood, plywood, Masonite, cardboard, paper, cloth, solid plastic or the like and may be completely rigid, or foldable or rollable for storage. The board can also be of metal and can be magnetically attractive to the playing pawns.

As explained in detail below, each player's Home Base may be occupied, with one exception, only by that player's own fighting pawns. But the entire rest of the board, the Open Board including also the Keter Zone, may be occupied at any time by the Fighting Pawns of both players.

The playing pieces used in the game of this invention are three sets of pawns, each set being equal in number to the number of squares in the Keter Zone, the pawns within each set being identical to each other but the three sets being mutually distinguishable from the other two sets by any convenient means such as form, design or color. Thus, with the preferred playing surface abovedescribed as containing 48 squares in the Keter Zone, there are used 48 Keter Pawns which, as shown in the drawing at (6), are placed on the squares of the Keter Zone at the beginning of a game, and each set of Fighting Pawns supplied to the respective players also contains 48 pieces.

The preferred pawns are made of suitable solid plastic such as polymethyl methacrylate and are cylindrical in form, with the Keter Pawns colored white, gray, black or clear and the Fighting Pawns colored red and yellow to correspond with the Home Bases. Wnen the individual squares are one inch on each side, it is preferred that the cylindrical pawns have the dimensions one inch in height and one-half inch in diameter. Obviously, the pawns could be made of any suitable material such as wood or metal.

The apparatus used in this invention comprises also means for selecting at random (a) which player is to make a move and (b) whether a move shall comprise 0, 1, 2, 3, 4, or 5 squares. Any appropriate device for random selection may be used such as a die which is thrown at random, or a pointing spinner which is rotated to stop at random over a circular diagram of the appropriate indicia, or one of various electronic random-selection devices. For example, a die may be used having randomly placed thereon the numbers 0, 1, 2, 3, 4 and 5. Or, alternatively, a conventional die having the numbers 1, 2, 3, 4, 5 and 6 may be used with the understanding that "6" signifies "0". Similarly, when the purpose is to select between adversaries, a special die may be used having randomly placed thereon three each of two colors or symbols corresponding to the respective adversaries. Or, alternatively, a conventional die may be used with the understanding that the odd numbers signify one of the players and the even numbers signify the other player. Corresponding methods using spinners, electronic devices or the like will be obvious to those familiar with games of chance.

According to the method of playing the game of this invention, each of the two competing players aims both to replace Keter Pawns by his own Fighting Pawns and to remove his opponent's pawns by capturing them. In so doing, the players must move according to the following unique set of rules which maintain the total number of pawns on the board throughout the game constantly equal to the starting number of Keter Pawns, which in the case of the above-described preferred gameboard is 48.

Rule I. Permissible Direction of Moves:

Keter Pawns may move only horizontally or vertically, as the Rook in chess. The Fighting Pawns may move horizontally, vertically and also diagonally, as the Queen in chess. All pawns can be moved backward as well as forward and can be moved forward and backward in the same move. The number of squares moved is that indicated by one of the abovedescribed means for random selection such as by the throwing of dice. This means of random selection is operated according to sequences described below in Rules V, VI, and VII. In counting out the indicated number of squares, it is not necessary that the squares en route be vacant; such squares may be occupied by any kind of pawn. The pawns may be moved anywhere except into an opponent's Home Base with one exception, namely: when the opponent has none of his Fighting Pawns on the open board outside his Home Base and there are no more Keter Pawns left on the board, a single entrance of a Fighting Pawn into that opponent's Home Base terminates the game even if there be a plurality of the opponent's Fighting Pawns left in that Home Base. Thus there are intriguing possibilities of competing strategy to balance the relatively protected state of Fighting Pawns kept in the Home Base against more aggressive tactics to avoid loss of Fighting Pawns on the open board. A player's Fighting Pawn may be moved back to that player's own Home Base at any time.

Rule II. Initial Introduction of Fighting Pawns on the Board is accomplished by moving a Keter Pawn to a Player's own Home Base, whereupon the Keter Pawn is replaced by a Fighting Pawn of that player. In moving a Keter Pawn into the Home base, it is not necessary to have an indicium corresponding exactly to the number of squares from the position of the Keter Pawn to the Home Base. Thus, if it takes a move of 2 squares to reach the Home Base, this may be accomplished if the indicium is 2 or greater, namely 3, 4 or 5 as well. Additional Fighting Pawns may likewise be introduced at the Home Base during any stage of the game by using random indicia conventially selected, according to the order of play, to move Keter Pawns to Home Base.

Rule III. Capturing Keter Pawns:

As soon as at least one of a player's Fighting Pawns is on the board, a Keter Pawn may be replaced with a Fighting Pawn by the operation of capturing, accomplished by termination of a permitted move on a square occupied by the Keter Pawn. The captured Keter Pawn is removed from the board and a new pawn of the capturing type is placed in its square in addition to the capturing pawn, thus leaving two pawns of the capturing variety on the same square. By this unique procedure of capture, with the removal of a Keter Pawn from the board and simultaneous addition of a capturing pawn to the board, the total number of pawns on the board remains constant.

It is permissible to place two Fighting Pawns on the same square without capturing, by simple termination of a move by a Fighting Pawn on a square already occupied by another pawn of the same variety. But no more than two pawns may occupy a single square.

As explained under the following Rule IV, two pawns on the same square are more vulnerable to the opponent's Fighting Pawns. A player will therefore try to move one of the doubled-up pawns to a separate square as soon as possible.

As players become more aware of the multitude of possibilities in the relative placing of pawns, they can develop all sorts of anticipatory strategy that make the game an exhilerating experience.

Rule IV. Capturing Opponent's Fighting Pawns:

An opponent's pawn is captured when termination of a permitted move takes place on a square occupied by said opponent pawn. The opponent's pawn is removed from the board, the capturing pawn is left in its place and a Keter Pawn not on the board is placed by the capturing player on an unoccupied square of his choice in the Keter Zone. Thus, again, the total number of pawns on the board remains constant.

If termination of a permitted move takes place on a square occupied by two of the opponent's pawns, both such pawns are removed from the board and the capturing player places two Keter Pawns on unoccupied squares of his choice in the Keter Zone. Obviously, therefore, having two Fighting Pawns on the same square presents greater vulnerability and a player will try to avoid this by separating such pawns to different squares as soon as possible.

Rule V. Order of Play: The Start:

At the beginning of a game of this invention, the Keter Pawns have been placed on the respective squares in the Keter Zone. The starting player is then chosen by any suitable means of random choice. The preferred method of choosing the starting player is for each player to throw a numbered die, the player obtaining the higher number being selected as the starting player. Alternatively a coin could be tossed or there could be used any of the above-described means for random selection.

Rule VI. Cycle of Seven Moves Each:

There then follows a series of seven pairs of "rolls" or "spins". In each such pair first the starting player and then the second or following player randomly selects a number from 0, 1, 2, 3, 4 and 5, as by one of the above-described methods, and moves a single piece on the board a corresponding number of squares.

The first objective of each player will be to move at least one Keter Pawn to his Home Base. When any Keter Pawn reaches a player's Home Base, it is exchanged for one of that player's Fighting Pawns, according to Rule II.

As soon as at least one Fighting Pawn is on his Home Base, a player may use his randomly selected number to move one of his Fighting Pawns the selected number of squares. At first such moves may have to terminate on vacant squares but eventually the positions of the three types of pawns will be sufficiently close to enable the termination of a move on a square occupied by either a Keter Pawn or an opponent's Fighting Pawn, capturing taking place according to Rule III and Rule IV. At any stage of the game a player may use his rolled or spun number to move either one of his Fighting Pawns or a Keter Pawn. A unique challenge is presented to use skill in selecting the pieces to be moved and moving them to capture either Keter Pawns or opponent's Fighting Pawns while at the same time trying to avoid any capture of his own pawns by the opponent's pawns.

Rule VII, "OPERATIONS OF FATE":

After the aforedescribed seven sets of "rolls" or "spins", there are two sequences called operations of fate. The lucky player to carry out the moves in the first of these sequences and the lucky player to carry out the moves in the second of these sequences are separately chosen by chance. The order of turns at this point of the game is therefore a break in he simple alternation of the preceding cycle of seven moves. An additional element of chance is thus introduced which makes it impossible for a player to place the pieces during the Cycle of Seven in easy preparation for the next operation, since it is unknown in advance which player is going to have the privilege of carrying out each next move.

(VIIa) First Operation of Fate:

The starting player first makes (i) a random selection to indicate which player will be the first lucky player who makes the first operation of fate, and also (ii) a random selection of a segment number, x, from the numbers 0, 1, 2, 3, 4 and 5. Thus, for example, he may throw two dice either in succession or simultaneously, one die having randomly placed thereon two sets of three indicia, each set corresponding to one of the players; the other die having randomly placed thereon the numbers 0, 1, 2, 3, 4, and 5.

In carrying out the first fate operation, the first lucky player thus chosen now makes a number of moves within which is a multiple of seven and the randomly selected segment number, x. If $x=0$, then obviously no move is possible. But if x equals 1, 2, 3, 4 or 5, then the player has the right to make 7x moves from square to square. In doing this he must make a choice between either (i) moving a single pawn 7x squares, i.e. moving one piece in seven segments of x squares each, or (ii) moving seven different pieces x squares each, i.e. each of seven pawns moves a number of squares corresponding to the segment number. The pieces selected for these moves can be either Keter Pawns or Fighting Pawns. When seven different pawns are operated, some of these may be Keter Pawns while others may be Fighting Pawns. When a single Fighting Pawn is thus moved, said pawn can capture a Keter or Fighting Pawn at the termination of each segment of x squares in the usual manner, provided one of such capturable pawns is on the square of such termination. Likewise, when seven different pawns are used, capturing can take place at the end of each such move made by a Fighting Pawn.

Thus, if x is 5 and a single Fighting Pawn is used, a capture can be made at every fifth square of the move, if that square is occupied by a capturable pawn. Or, if seven different pawns are moved five squares each, then each Fighting Pawn terminating such a move on a square occupied by a capturable pawn captures that pawn. All such captures are carried out in the appropriate manner of Rule III or Rule IV as the case may be.

(VIIb) Second Operation of Fate:

The player other than the starting player then has his turn to make a random selection as to which player will be the second lucky player to make a second operation of fate in a manner similar to that described in section VIIa. The second lucky player now makes 7x moves in the manner described for the first lucky player, capturing according to Rules III and IV. Because the first and second lucky players are both selected by chance, they may be the same player.

Rule VIII. Repeated Cycles in Continued Play:

After this second operation of fate, the play is resumed in the manner described under Rule VI and Rule VII excepting that the new starting player will be the opposite of the second lucky player. The new starting player may thus be either the same as the original starting player selected as in Rule V, or he may be the original players opponent. This adds a further element of the unexpected in the progress of the game.

Play is continued with repetitions of "cycles of seven" as set forth in Rule VI followed by "operations of fate" as set forth in Rule VII until one of the players succeeds in placing all of his Fighting Pawns on the board with complete elimination of Keter Pawns and opponent's Fighting Pawns. Each player attempts to reach this objective as soon as possible. By capturing Keter Pawns, a player succeeds directly toward the objective of replacing all the Keter Pawns with his own Fighting Pawns. By capturing his opponent's Fighting Pawns, a player frustrates in part his opponent's objective to do likewise, but a Keter Pawn is simultaneously put back again in the Keter Zone as bait for both players.

According to Rule I, when all the Keter Pawns have been removed from the board, if a losing player's one or more remaining Fighting Pawns are all in his Home Base, these may all be taken in one move if his opponent is lucky enough to obtain a random indicium permitting a move of one of his Fighting Pawns into that Home Base before the losing player can move at least one Fighting Pawn out on the open board. This is the only situation permitting an opponent to enter a player's Home Base.

Thus, with this one exception, the winner always achieves his goal by actually capturing each Keter Pawn and replacing it with one of his own pawns. When he captures an opponent's pawn, the captured pawn is replaced by a Keter Pawn and in order for him to get a new pawn of his own on the board he must then capture the Keter Pawn. Since he must first place the Keter Pawn back on a square of the Keter Zone, there is a challenge to use his skill in such placement so as to make that returned pawn easily capturable by him with a minimum vulnerability from attack on his pawns by the opponent's pawns.

To recapitulate, the game is terminated when all the Keter Pawns have been removed from the board and the pawns on the board are all the Fighting Pawns of one of the players, who thus becomes the winner. At the end of the game, the winner has replaced each Keter Pawn with one of his Fighting Pawns.

As players become more familiar with the possibilities of placing and capturing pawns, new sophistications in strategy can occur to them, making this game very challenging to the use of skill. On the other hand, the rules are simple enough, once they are learned, to provide an entertaining game for young children. Depending on the amount of skill applied, a single game may last for several hours without becoming tedious, but experts have been able to terminate a game within as short a time as about a half hour. An additional challenge may be introduced by placing a limit on the time allowed for deciding upon each move.

Variations possible in playing board:

It will readily be understood that the geometry of the preferred playing surface described above can be altered in various ways without departing from the spirit of this invention. Instead of having a square board, the shape might be a rectangle which has the players' sides shorter or longer than the sides perpendicular to the players' sides. The total number of squares on the board could also be either increased or decreased beyond that specified for the preferred board; and the size and shape of the Home Bases could be changed somehwat fron the particular rectangles in the preferred example. However, all such boards would have in common the properties that the Home Bases would be contiguous to the respective players' sides and the Keter Zone would comprise the two rows of squares midway between the players.

Thus, according to the basic concept of this invention the game board provided is a rectangular playing surface having a field of ($n \times m$) equally-sized squares wherein n and m are whole numbers between about 10 and 50, and wherein n may be greater than, equal to or less than m, and wherein the sides having n squares are identified as the players' sides; said playing surface having equidistant from and parallel to said players' sides a rectangular zone identified as the Keter Zone, the dimensions of said Keter Zone being the full length of the board in the direction perpendicular to the players' sides; said playing surface also having, contiguous to each of the player's sides, two corresponding rectangles identified as the Home Bases, each Home Base being equidistant from the ends of the respective player's side and having an area covering from about 2 to about 4 whole squares in the direction parallel to the players' sides and 2 or 3 whole squares in the direction perpendicular to the players' sides.

Although particular embodiments of this invention have been shown and described in full herein, there is no intention thereby to limit the invention to the details of such embodiments. On the contrary, the invention is to cover all modifications, alternatives, usages and equivalents of a game as fall within the spirit and scope of this invention, specification and appended claims.

What I claim is:

1. A method of playing a game for two players which comprises the steps of (A) providing three sets of playing pieces including means for distinguishing each of these sets from the other two and providing an equal number of pieces in each set;

(B) providing between the players a rectangular board marked off into a plurality of equal-sized squares, wherein ($B_1$) the two rows of squares half-way between the players, identifiable as the MID-ZONE have placed thereon, before commencement of play, all the pieces of one of the three sets, identifiable as the initial or BOARD set of pieces, one BOARD piece being on each square of said MID-ZONE, the said equal number of pieces in each set thus being equal to the number of squares in the MID-ZONE, and ($B_2$) in the middle of each player's end of said board there is a relatively small rectangle of squares, including several squares in the first line of said player's side, marked off as a respective HOME BASE accessible only to said repective player, the remaining squares on the entire board being accessible at all times to any playing piece of either player, once said piece has been placed on the board by means hereinafter set forth;

(C) providing chance means manipulatable by said players for placing and moving said pieces on said board, said chance means comprising a device for indicating at random a number selected from zero, 1, 2, 3, 4, and 5;

(D) each of said players being provided with one of the remaining sets of playing pieces, identifiable as his OWN playing pieces in contrast to the BOARD pieces which are never possessible by either player;

(E) selecting one of said two players as the one to commence play, this play being identifiable as the FIRST PLAYER;

(F) manipulating said chance means to determine the number of spaces which the FIRST PLAYER may move any of the BOARD pieces toward his own HOME Base;

(G) manipulating said chance means to determine the number of spaces which the SECOND PLAYER may move any of the BOARD pieces to his own HOME BASE;

(H) manipulating said chance means to determine the successive alternate moves of the players who may use the indicium number to (i) move the same or other BOARD pieces, removing from the Board any BOARD piece which reaches his HOME BASE and replacing it with one of his OWN pieces, or (ii) move one of his thus-placed OWN pieces from his HOME BASE on to the open board, or (iii) move either a BOARD piece or one of his OWN pieces in such a manner as to have said two pieces occupy an identical otherwise unoccupied square, replacing the BOARD piece by another of his off-the-board OWN pieces (leaving two identical pieces temporarily on the same square) and removing the BOARD piece from the board, or (iv) move one of the player's OWN pieces to the same space already occupied by an opponent's OWN piece or pieces, removing said opponent's piece or pieces from the board and placing anywhere in the MID-ZONE a BOARD piece (From off the board) for each opponent's thus removed OWN piece,—all of such possible moves being such that the total number of pieces on the board remains constant;

(I) and repeating the alternating steps set forth in (H) until one of the players has the complete set of his OWN pieces on the board.

2. The method of claim 1 wherein the rectangular board is a square with 24 playing squares on each side and wherein the number of each set of playing pieces is correspondingly 48.

3. The method of claim 1 wherein strings of alternate moves as in paragraph (H) are interspersed with intervals comprising two "operations of fate" in each of which a lucky player is randomly selected to make seven segmentary moves, each segment of which consists of the same number of squares which number also is randomly selected, and wherein the conditions of (H)iii and (H)iv are effective at the termination of each segmentary move which can be performed either by a single piece moving continuously or by seven separate pieces.

4. The method of claim 1 wherein, if all the BOARD pieces have been removed off the board but the only remaining pieces owned by the opponent are situated in that opponent's HOME BASE, a player may become the winner by using a random indicium of the chance means to move one of his OWN pieces into that otherwise impenetrable HOME BASE.

* * * * *